US010174549B1

(12) United States Patent
Chou

(10) Patent No.: US 10,174,549 B1
(45) Date of Patent: Jan. 8, 2019

(54) UNIVERSAL OMNI ADAPTOR

(71) Applicant: Tser Wen Chou, Yorba Linda, CA (US)

(72) Inventor: Tser Wen Chou, Yorba Linda, CA (US)

( * ) Notice: Subject to any disclaimer, the term of this patent is extended or adjusted under 35 U.S.C. 154(b) by 0 days.

(21) Appl. No.: 15/807,207

(22) Filed: Nov. 8, 2017

(51) Int. Cl.

| | |
|---|---|
| ***E06B 9/262*** | (2006.01) |
| ***E06B 9/322*** | (2006.01) |
| ***A47H 1/14*** | (2006.01) |
| *E06B 9/42* | (2006.01) |

(52) U.S. Cl.
CPC ..... *E06B 9/322* (2013.01); *A47H 1/14* (2013.01); *E06B 9/262* (2013.01); *E06B 9/42* (2013.01)

(58) Field of Classification Search
CPC . E06B 9/322; E06B 9/262; E06B 9/42; A47H 1/14
USPC ..... 248/309.1, 298.1, 575, 246, 247, 300; 24/542
See application file for complete search history.

(56) References Cited

U.S. PATENT DOCUMENTS 1,744,196 A * 1/1930 Ames ..... B60R 13/005 24/336
D173,720 S * 12/1954 Carver et al. ..... 248/300
3,286,422 A * 11/1966 Pangerl ..... E04F 19/0463 52/288.1
4,691,392 A * 9/1987 Whitney ..... A47K 3/001 4/595
5,170,977 A * 12/1992 McMillan ..... E04B 1/2608 248/300
5,996,957 A * 12/1999 Kurtz ..... A47G 23/0225 248/231.21
6,601,809 B1 * 8/2003 Gebrara ..... G09F 7/18 160/38
7,455,278 B2 * 11/2008 Hsu ..... A47J 37/041 248/300
8,091,847 B2 * 1/2012 Schnitzer ..... F24J 2/5203 248/205.1
8,096,516 B2 * 1/2012 Shiao ..... B25H 3/04 211/70.6
8,317,144 B2 * 11/2012 Schouten ..... E04G 5/00 24/380
8,464,987 B1 * 6/2013 DeCesare ..... H02G 3/34 24/458
8,806,815 B1 * 8/2014 Liu ..... H01L 31/0422 52/173.3
9,617,785 B2 * 4/2017 Chou ..... E06B 9/24
2002/0145095 A1 * 10/2002 Winkler ..... A63B 57/00 248/300

(Continued)

*Primary Examiner* — Muhammad Ijaz
(74) *Attorney, Agent, or Firm* — Guice Patents PLLC

(57) ABSTRACT

A universal omni adaptor includes a connection board as a main body. The connection board includes a board main body, a first connection section and a second connection section. The board main body is for installing a blind assembly thereunder. The board main body is formed with several breakage slits, whereby the connection board can be broken along one of the breakage slits to shorten the length in adaptation to different sizes of windows, whereby the blind can be installed on different sizes of windows. The first and second connection sections are formed with toothed stripes at different heights, whereby the decorative panel can be selectively assembled in a higher position or a lower position for installation on different sizes of windows to speed the installation of the blind assembly.

2 Claims, 12 Drawing Sheets

(56) References Cited

U.S. PATENT DOCUMENTS

| | | | | |
|---|---|---|---|---|
| 2003/0122047 | A1* | 7/2003 | Joliey | G09F 3/204 248/300 |
| 2007/0187566 | A1* | 8/2007 | Price | A47G 1/1613 248/477 |
| 2009/0101288 | A1* | 4/2009 | Yu | E06B 9/262 160/84.05 |
| 2010/0059641 | A1* | 3/2010 | Twesme | F24J 2/5205 248/205.3 |
| 2011/0061337 | A1* | 3/2011 | O'Shea | E04F 13/0808 52/747.12 |
| 2011/0108678 | A1* | 5/2011 | Park | B60K 13/04 248/49 |
| 2011/0260027 | A1* | 10/2011 | Farnham, Jr. | F24J 2/5207 248/309.1 |
| 2012/0187267 | A1* | 7/2012 | Hudson | F24J 2/5247 248/292.14 |
| 2013/0134270 | A1* | 5/2013 | Gagne | F16M 13/02 248/205.1 |
| 2014/0202525 | A1* | 7/2014 | Janssens | F16B 2/20 136/251 |
| 2016/0025262 | A1* | 1/2016 | Stearns | H01Q 1/12 248/70 |
| 2016/0268958 | A1* | 9/2016 | Wildes | H02S 20/23 |

* cited by examiner

UNIVERSAL OMNI ADAPTOR

BACKGROUND OF THE INVENTION

1. Field of the Invention

The present invention relates generally to a universal omni adaptor, and more particularly to a blind component, by which the blind assembly is applicable to different sizes of windows and can be installed on different sizes of windows.

2. Description of the Related Art

In the installation of a blind assembly on the inner wall face of upper side of a window, the blind assembly (including blind sheet winder, reel and blind sheet) is generally previously assembled on an installation rail. Then, the installation rail is secured with securing plates. Then the installation rail is locked on the inner wall face of upper side of the window, whereby the blind can provide sunshade effect. In addition, in order to conceal the blind assembly to enhance the beauty of the appearance, the conventional installation rail has a decorative panel integrally extending from the front end of the installation rail to conceal the blind assembly to achieve a beautiful appearance.

However, the conventional decorative panel and the installation rail are an integrated structure. Therefore, with respect to the operation space of installation, the blind assembly can be only installed from the lower space and lateral space of the installation rail. The narrow space leads to difficulty in installation of the blind assembly and slows down the installation rate.

Moreover, different windows have different sizes and the widths of the inner wall faces of different windows are inconsistent with each other. The conventional blind assembly has a fixed size so that the conventional blind assembly cannot be applied to different sizes of windows. Therefore, it is necessary to manufacture many different sizes of blind rails and decorative panels in adaptation to different sizes of windows. This leads to great increase of cost. Also, it is hard to achieve a beautiful appearance and speed the installation.

In order to solve the above problem of the conventional blind assembly in installation, the applicant has specifically disclosed U.S. Pat. No. 9,617,785 to achieve a beautiful appearance and speed the installation. However, in the patent, the decorative panel and the installation rail are assembled in an extensible/adjustable form in adaptation to the width of the inner wall face of the window. However, the widths and lengths of the inner wall faces of different windows are inconsistent with each other. Therefore, the structure of the patent is still inapplicable to all sizes of windows and the installation of the blind assembly is still limited.

SUMMARY OF THE INVENTION

It is therefore a primary object of the present invention to provide a blind component, by which the blind assembly is applicable to different sizes of windows and can be installed on different sizes of windows to achieve a beautiful appearance and speed the installation. The blind component includes a connection board as a main body. The connection board includes a board main body, a first connection section and a second connection section. The board main body of the connection board is formed with several breakage slits. The connection board can be broken along one of the breakage slits to shorten the length in adaptation to different sizes of inner wall faces of windows, whereby the blind assembly can be conveniently installed on the inner wall face of the window. The first and second connection sections of the connection board are both formed with toothed stripes at different heights for connection, whereby the decorative panel can be installed in adaptation to the size of the window to achieve a tidy and beautiful appearance.

To achieve the above and other objects, the blind component of the present invention includes a connection board for installation of the blind assembly. The connection board includes a board main body, a first connection section and a second connection section. An upper face and a lower face of the board main body are respectively formed with several breakage slits. When the blind assembly is installed to a window with a smaller size, the connection board can be broken along one of the breakage slits to shorten the length in adaptation to the length of the inner wall face of the window. The lower face of the board main body is for securely installing the blind assembly thereunder. The first and second connection sections are both formed with toothed stripes for connecting with the connection seats of the blind assembly. The first connection section includes a vertical board downward extending from the board main body and a horizontal board horizontally extending from a rear end of the vertical board. The horizontal board is formed with the toothed stripes. The second connection section is formed with forward extending toothed stripes. The toothed stripes of the first and second connection sections are positioned at different heights for engaging with the corresponding toothed stripes of the connection seats. The decorative panel is connected with the connection seats, whereby the decorative panel can be installed in a higher position or a lower position to conceal the blind assembly so as to achieve a fully beautiful appearance.

The present invention can be best understood through the following description and accompanying drawings, wherein:

DETAILED DESCRIPTION OF THE PREFERRED EMBODIMENTS

Figure 1:
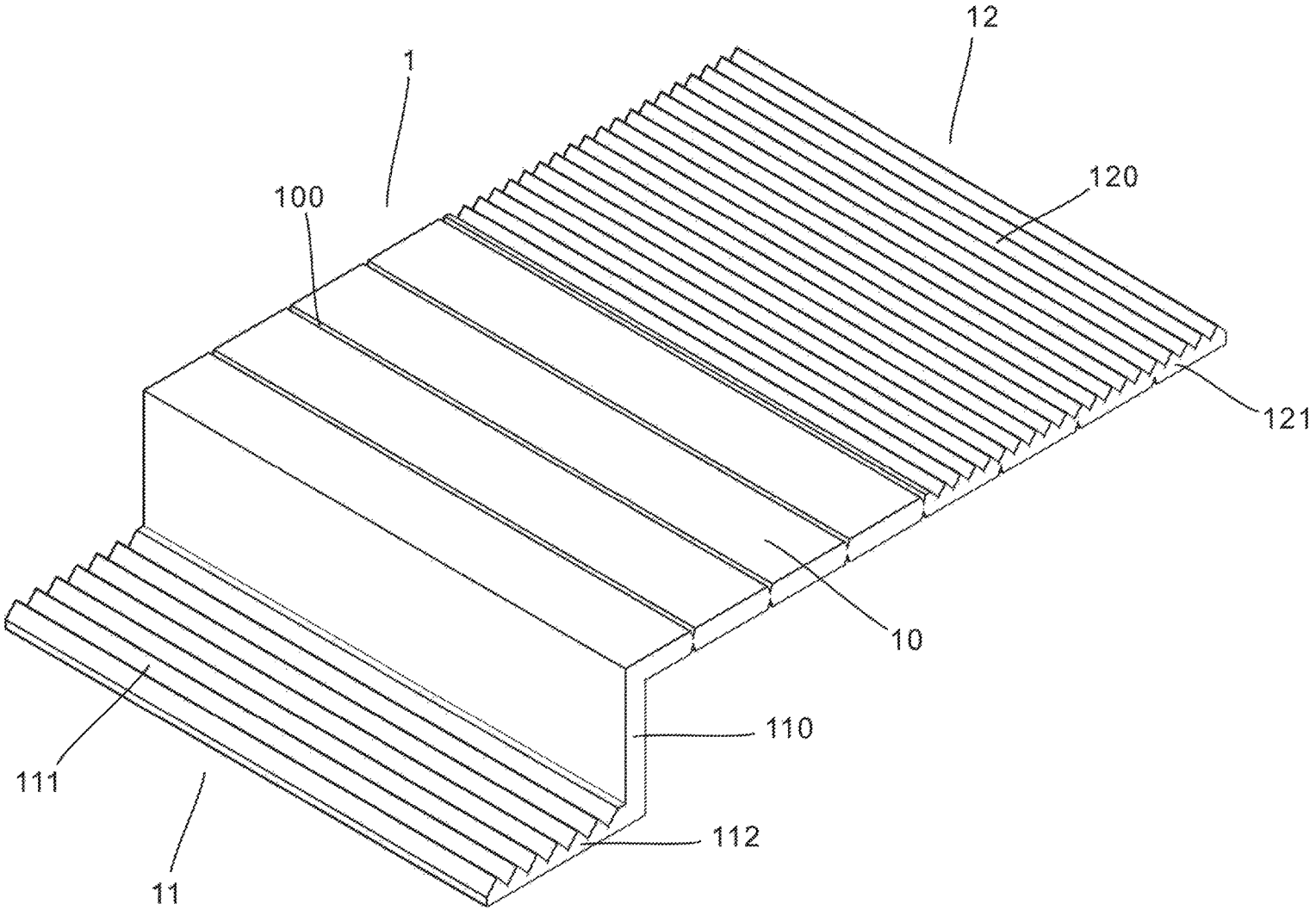
FIG. 1 is a perspective view of the connection board of the present invention.
Figure 2:
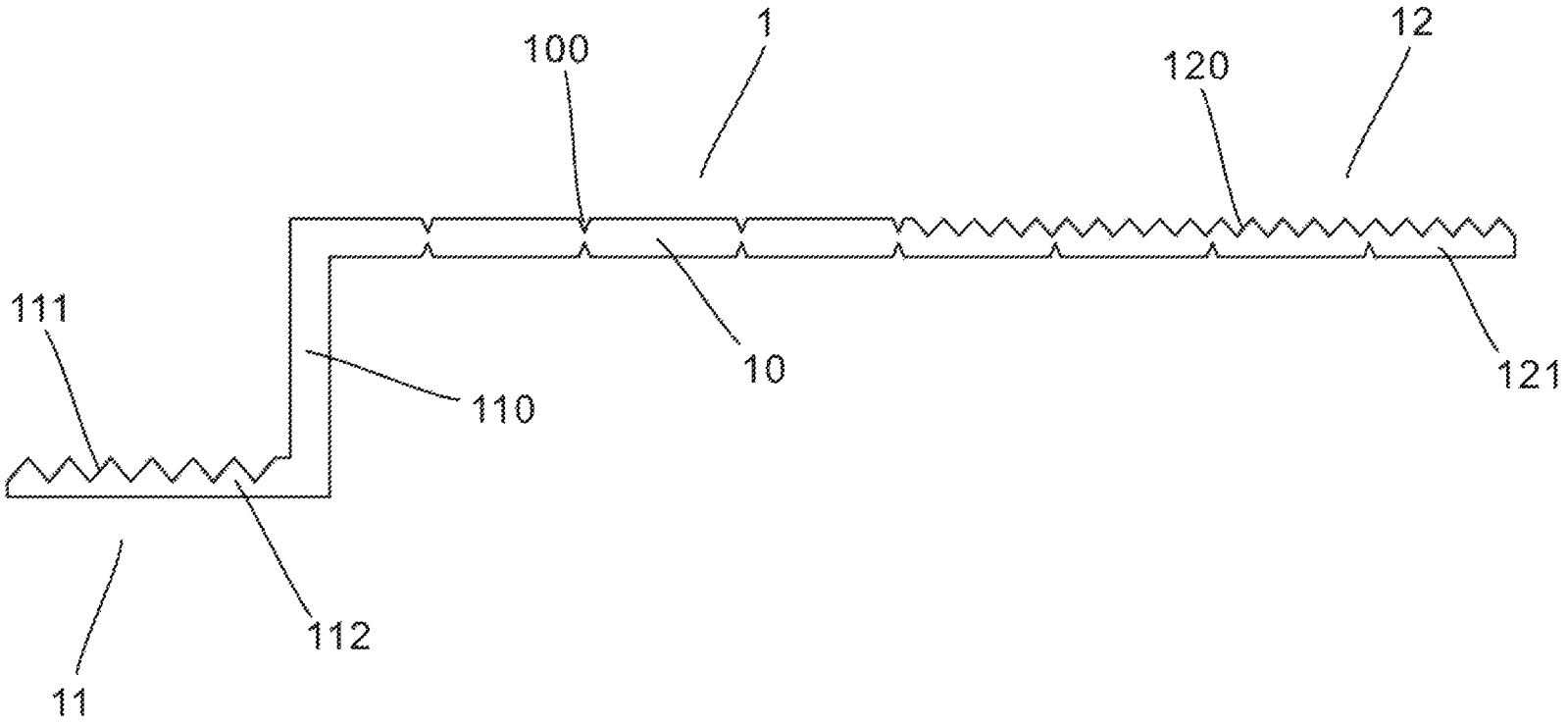
FIG. 2 is a side view of the connection board of the present invention.
Figure 3:
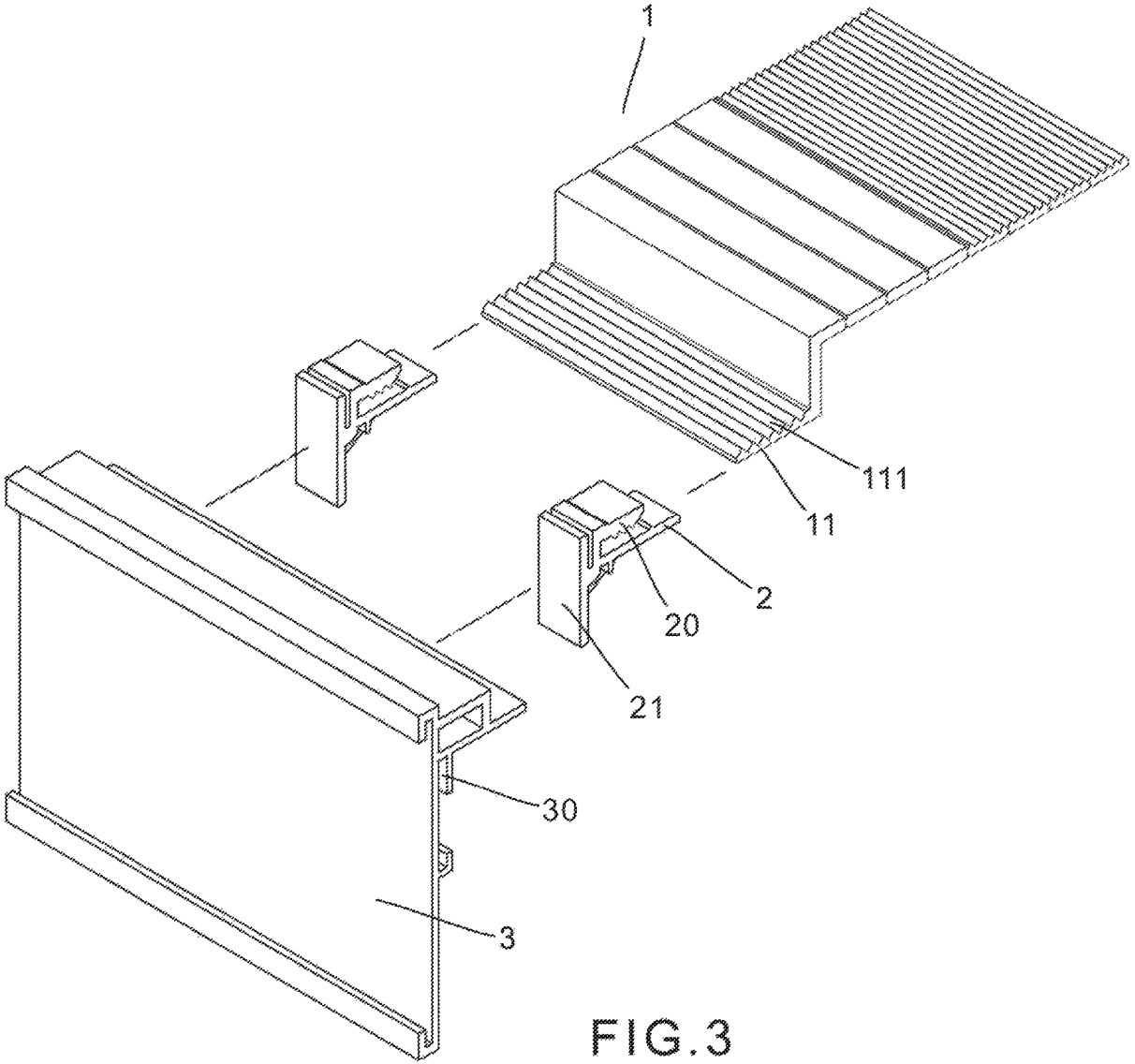
FIG. 3 is a perspective exploded view showing the installation of the connection board of the present invention.

Please refer to FIGS. 1 and 2. The universal omni adaptor of the present invention includes a connection board 1 as a main body. The connection board 1 has a board main body 10, a first connection section 11 and a second connection section 12. The upper and lower faces of the board main body 10 are formed with several breakage slits 100. The first connection section 11 includes a vertical board 110 vertically extending from the board main body 10 and a horizontal board 112 horizontally extending from the vertical board 110 and formed with toothed stripes 111. The second connection section 12 includes a horizontal board 121 horizontally extending from the board main body 10 and formed with toothed stripes 120. Accordingly, the board main body 10 has toothed stripes 111, 120 at different heights.

Figure 4:
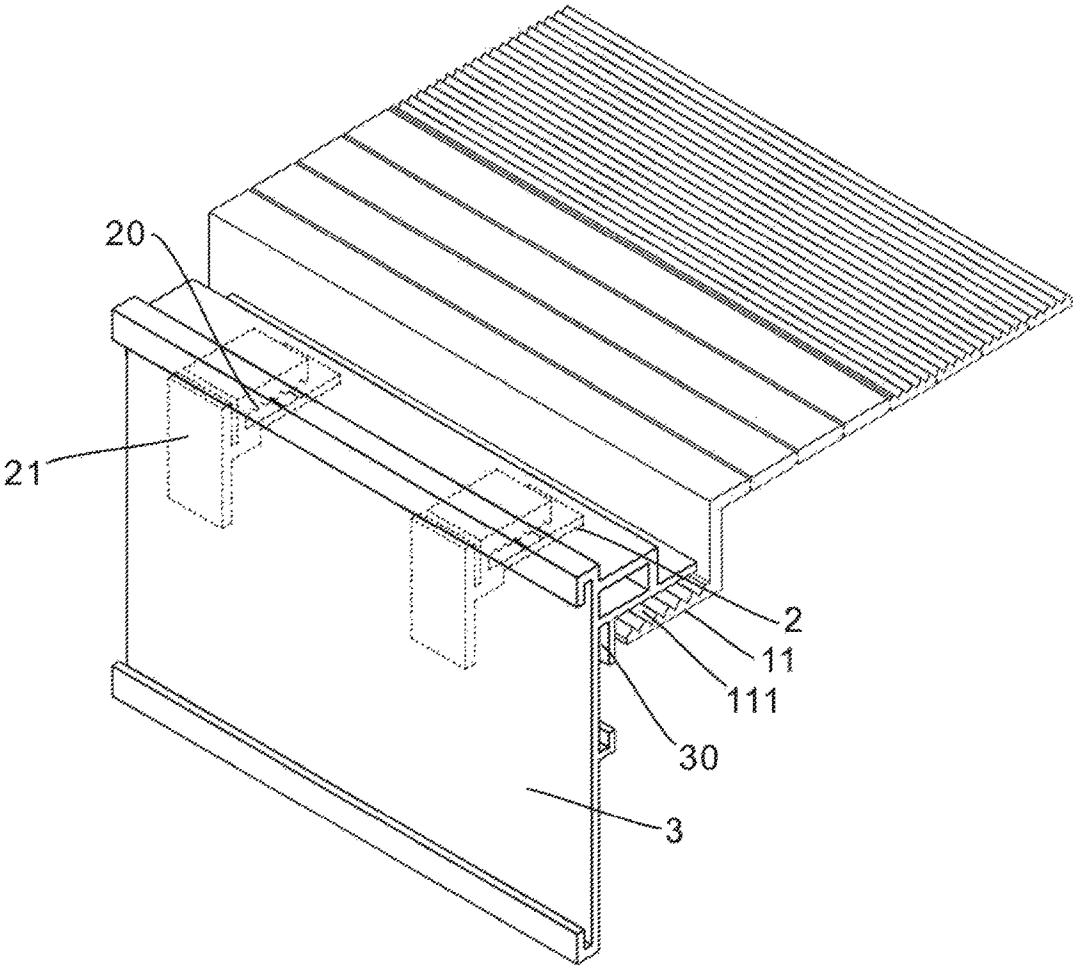
FIG. 4 is a perspective assembled view showing that the installation of the connection board of the present invention is completed.
Figure 5:
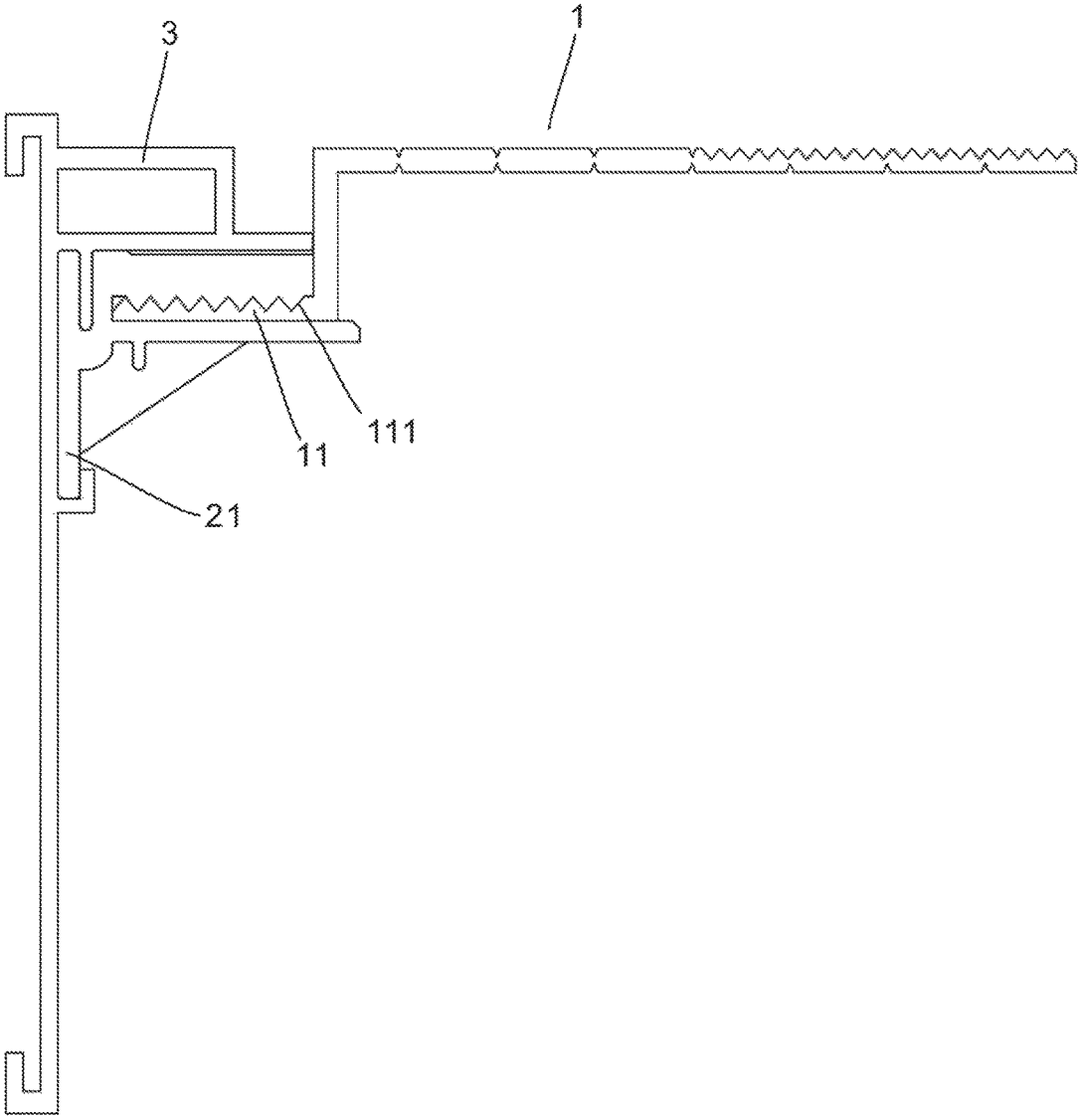
FIG. 5 is a side view showing that the installation of the connection board of the present invention is completed.
Figure 6:
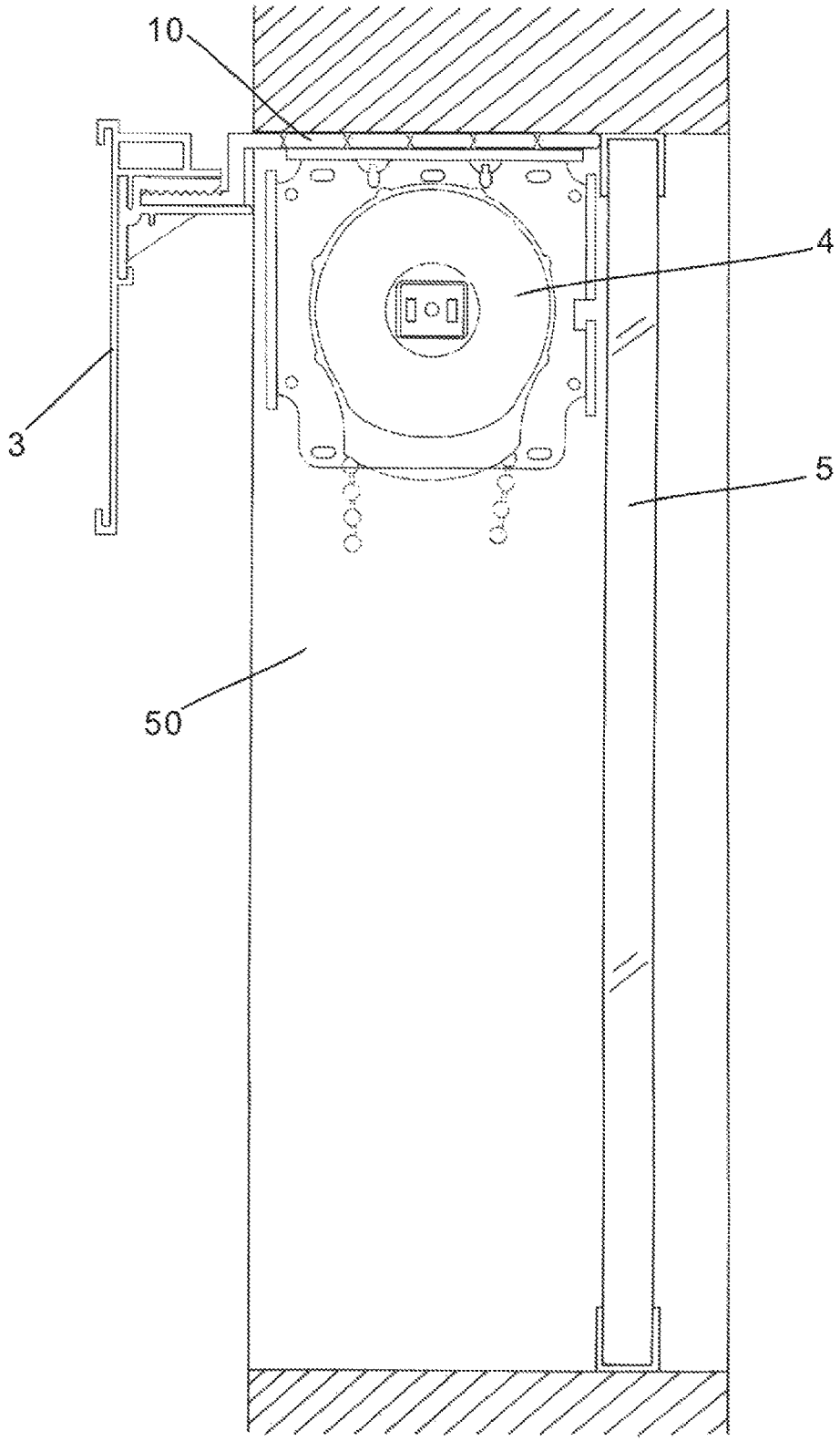
FIG. 6 is a side view showing that the blind assembly is installed under the connection board of the present invention.
Figure 7:
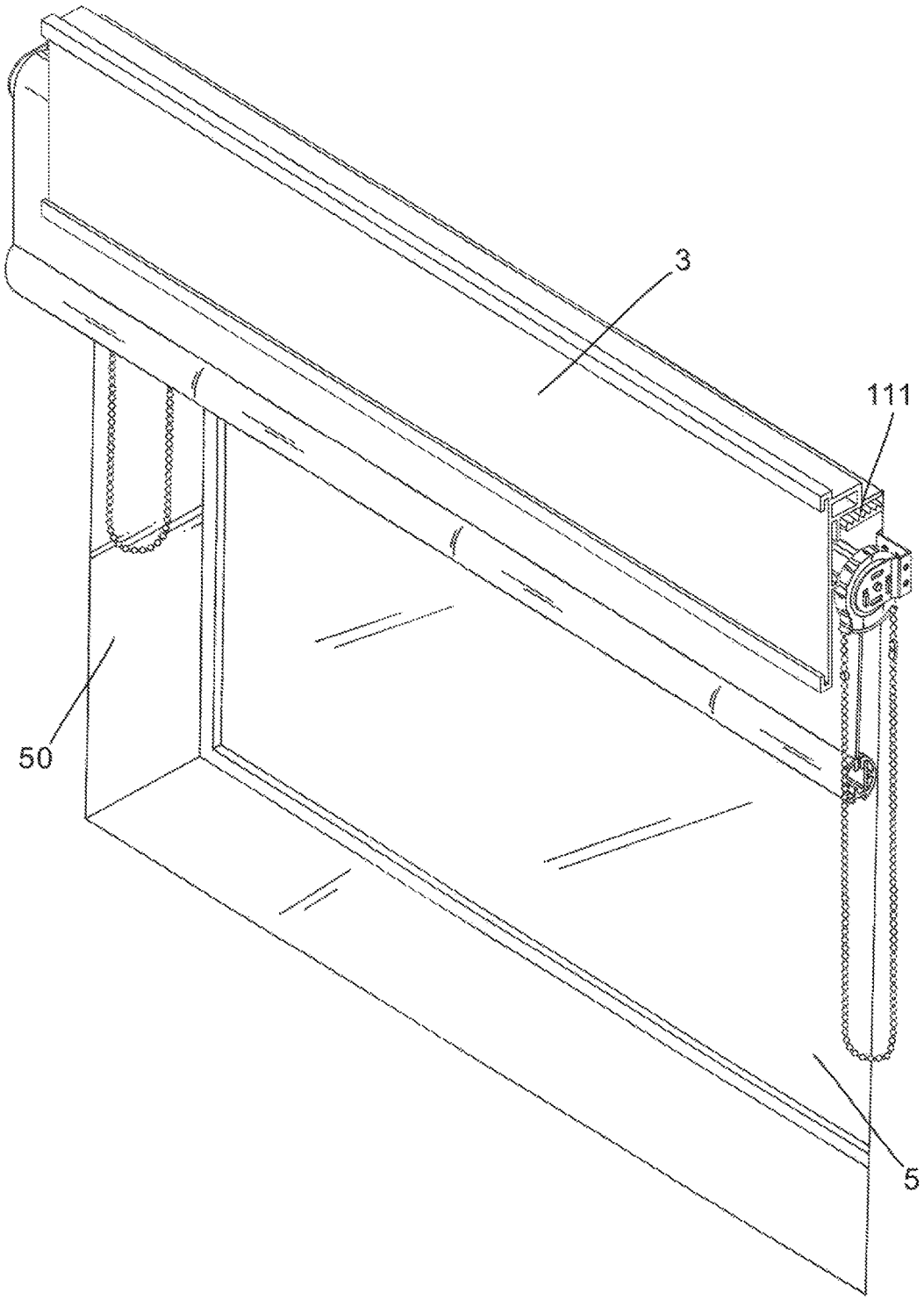
FIG. 7 is a perspective view showing that the blind assembly is installed under the connection board of the present invention.

When installed, (as shown in FIGS. 3 to 8), the first connection section 11 of the connection board 1 is connected with two connection seats 2. The toothed stripes 111 of the first connection section 11 are engaged with the toothed sections 20 of the connection seats 2 so as to connect the connection seats 2 with the first connection section 11. Then, the engagement plates 21 of the connection seats 2 are connected with the engagement channel 30 of the decorative panel 3 to integrally and securely connect the decorative panel 3 at the front end of the connection board 1 (as shown in FIGS. 4 and 5). After the decorative panel 3 is completely connected with the connection board 1, the blind assembly 4 is locked under the board main body 10 of the connection board 1. Then, the connection board 1 is directly locked on the inner wall face 50 of the window 5 to complete the installation of the blind assembly (as shown in FIG. 6). The decorative panel 3 conceals the blind assembly 4 to achieve a beautiful appearance (as shown in FIG. 7).

Figure 8:
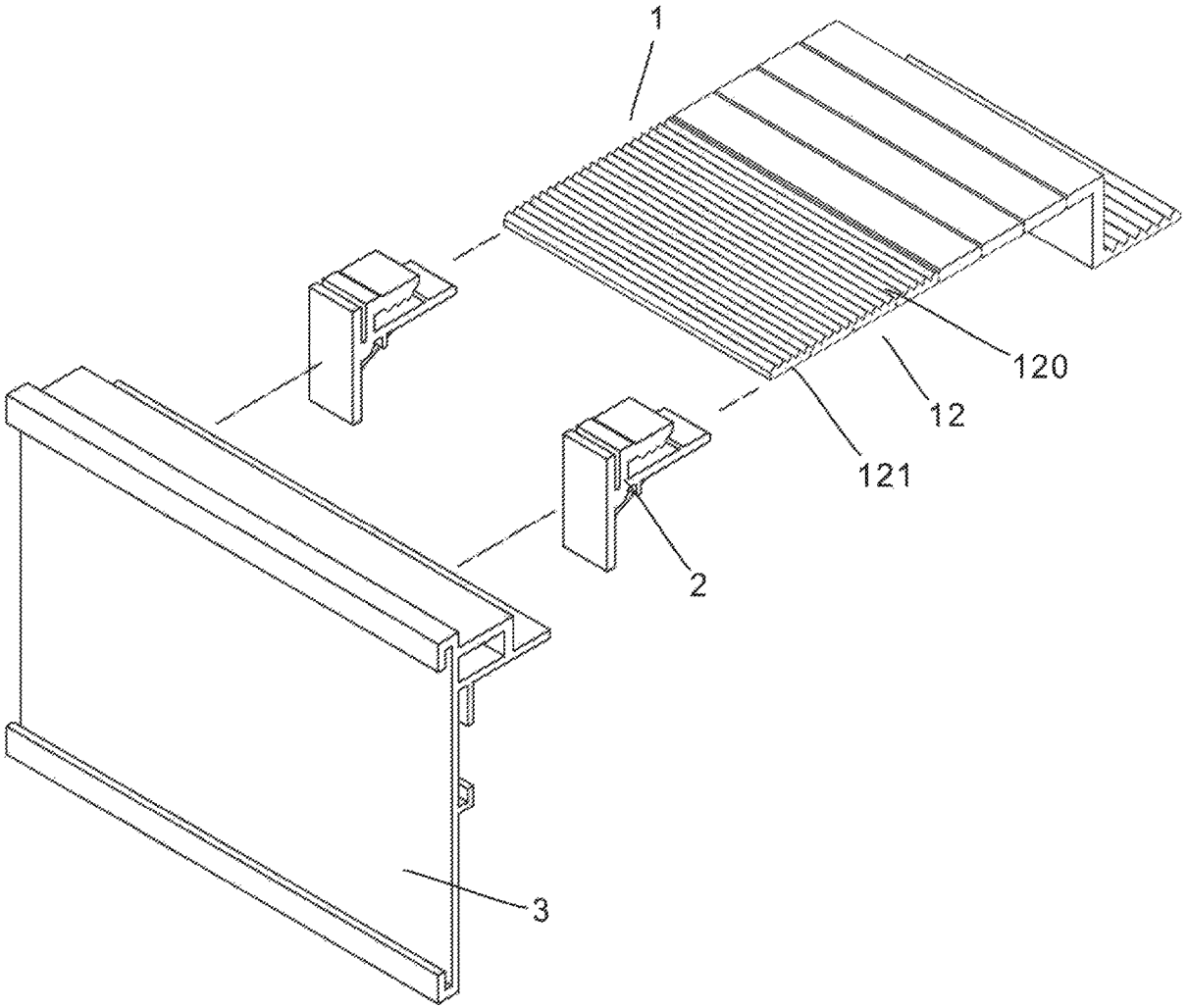
FIG. 8 is a perspective exploded view showing another embodiment of the installation of the connection board of the present invention.
Figure 9:
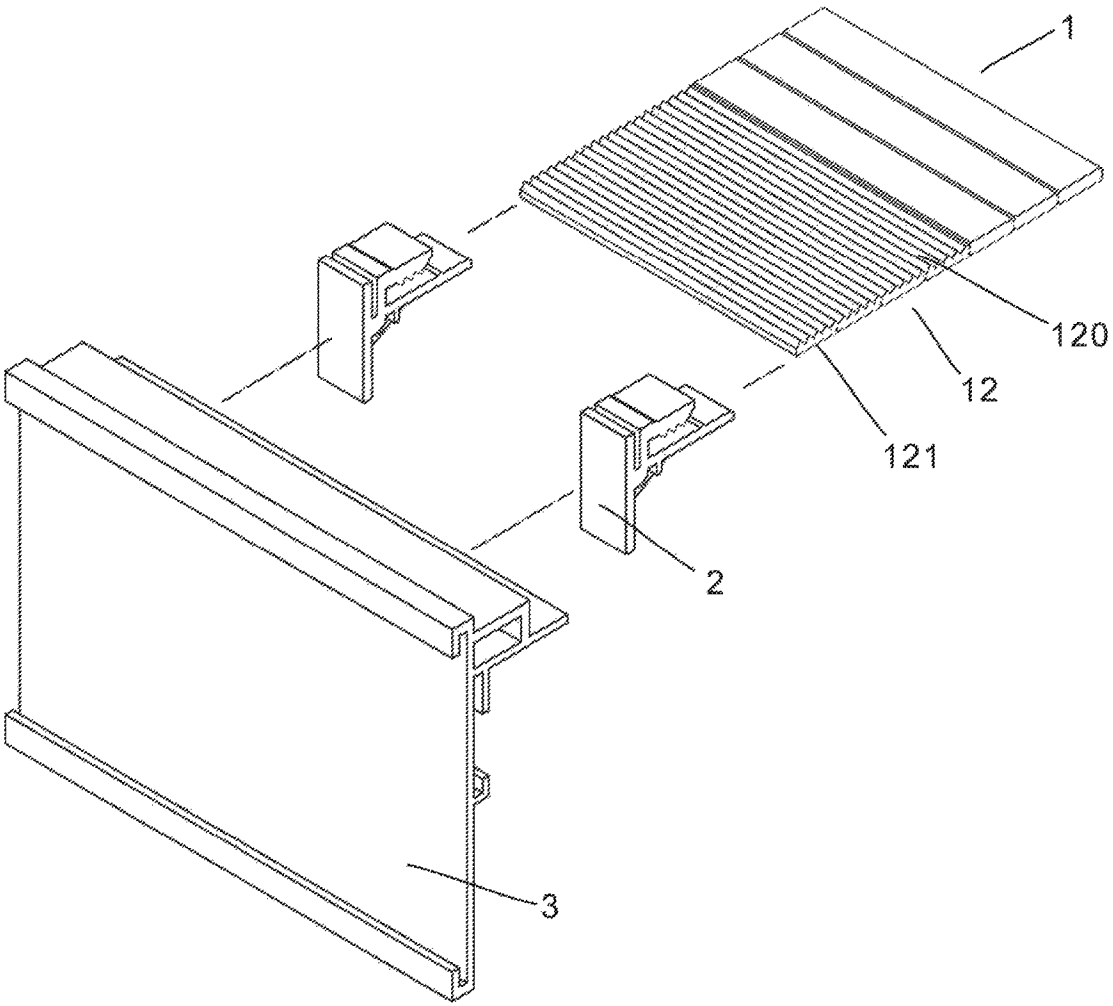
FIG. 9 is a perspective view showing that the connection board of the present invention is broken.
Figure 10:
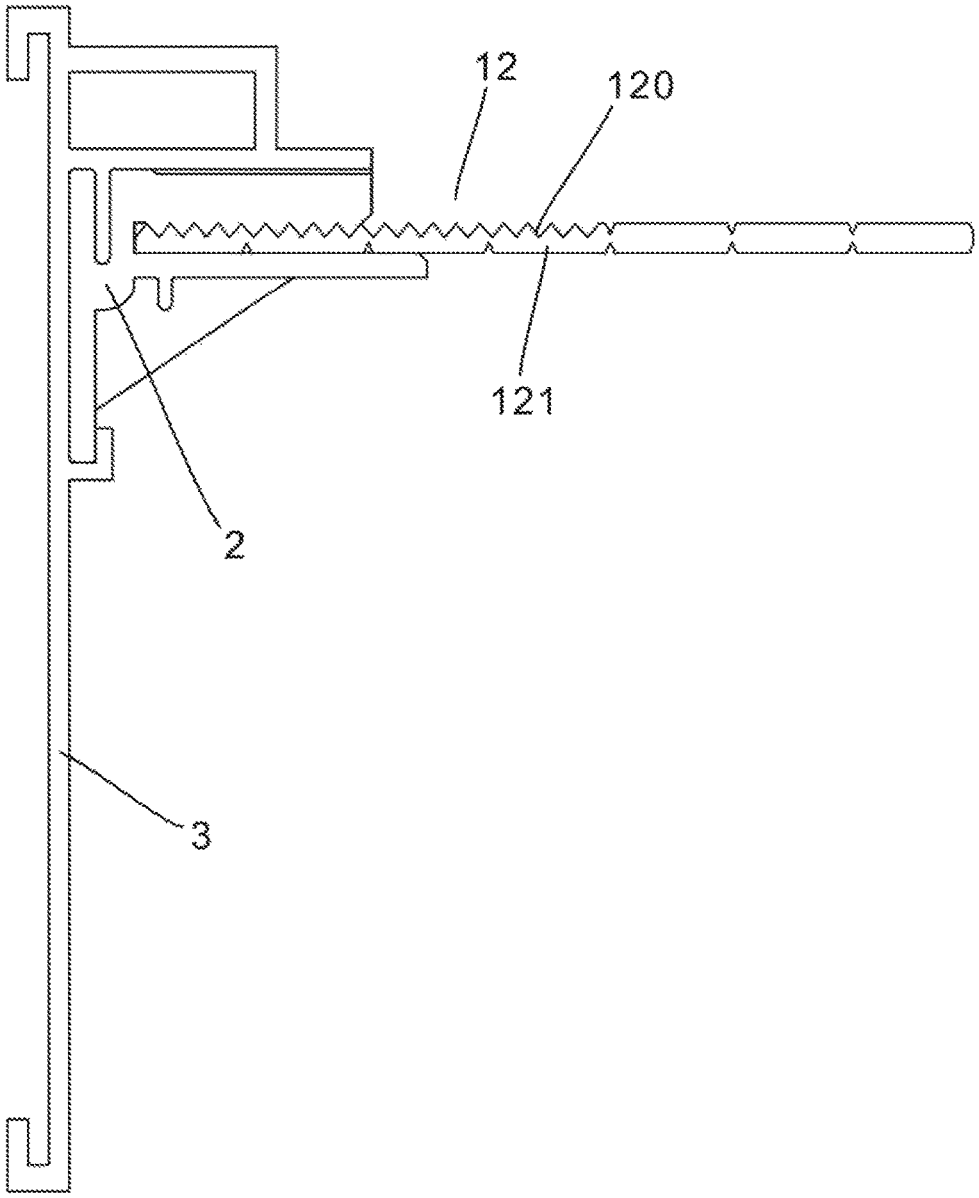
FIG. 10 is a side view showing another embodiment of the installation of the connection board of the present invention.
Figure 11:
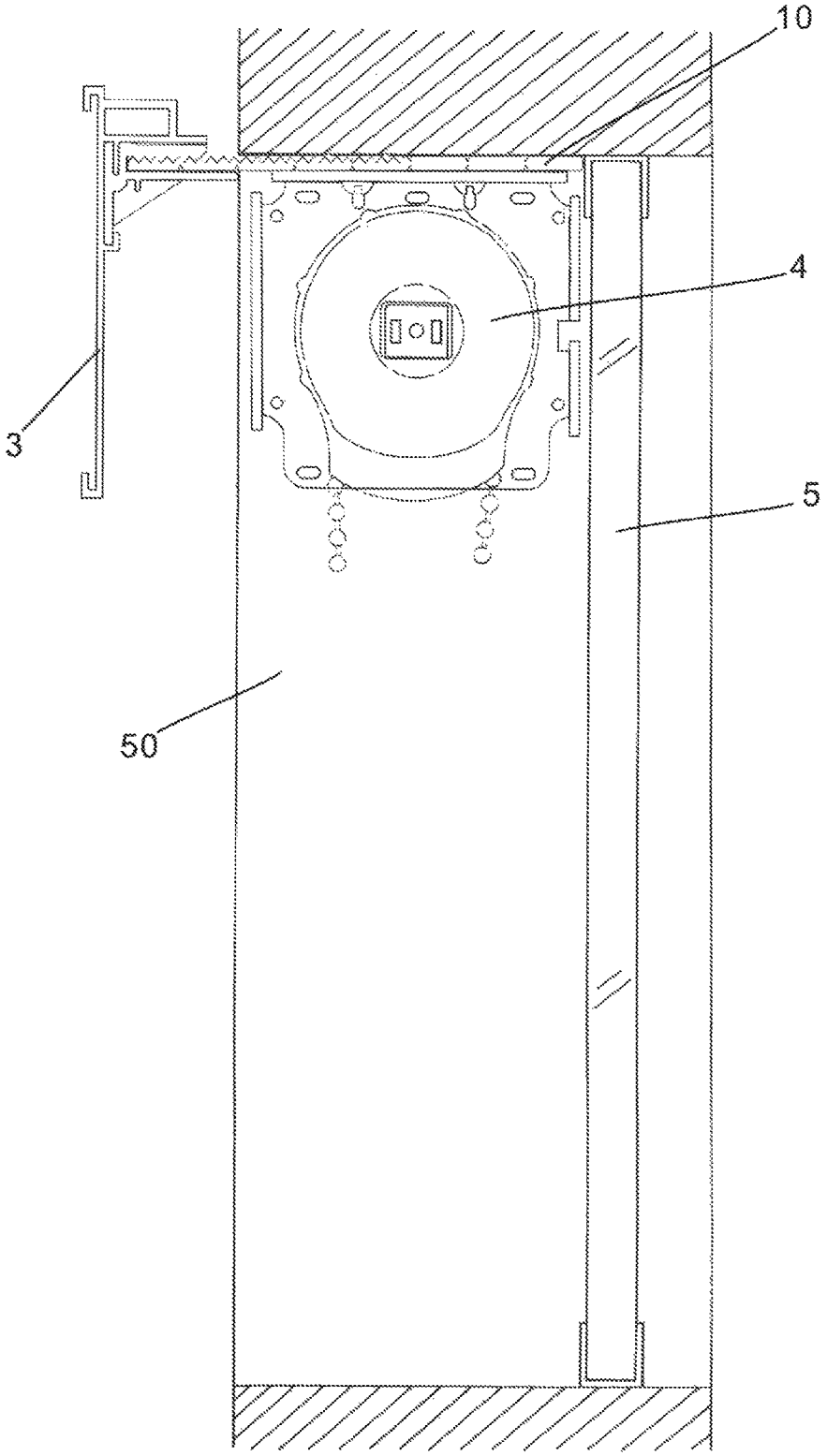
FIG. 11 is a side view showing that the blind assembly is installed under the connection board of the present invention.

In the case that a larger blind assembly is to be installed, the connection board 1 can be rotated (as shown in FIG. 8), whereby the toothed stripes 120 of the second connection section 12 are directly engaged with and integrally connected with the connection seats 2 and the decorative panel 3. Then, according to the length of the inner wall face of the window 5, the first connection section 11 is broken along the breakage slit 100 to forma horizontal connection board 1 (as shown in FIGS. 9 and 10). After the blind assembly 4 is installed under the board main body 10 of the connection board 1, the connection board 1 is locked on the upper edge of the inner wall face 50 of the window 5 to complete the installation of the blind (as shown in FIG. 11). Similarly, the decorative panel 3 conceals the blind assembly 4 to achieve a beautiful appearance.

Figure 12:
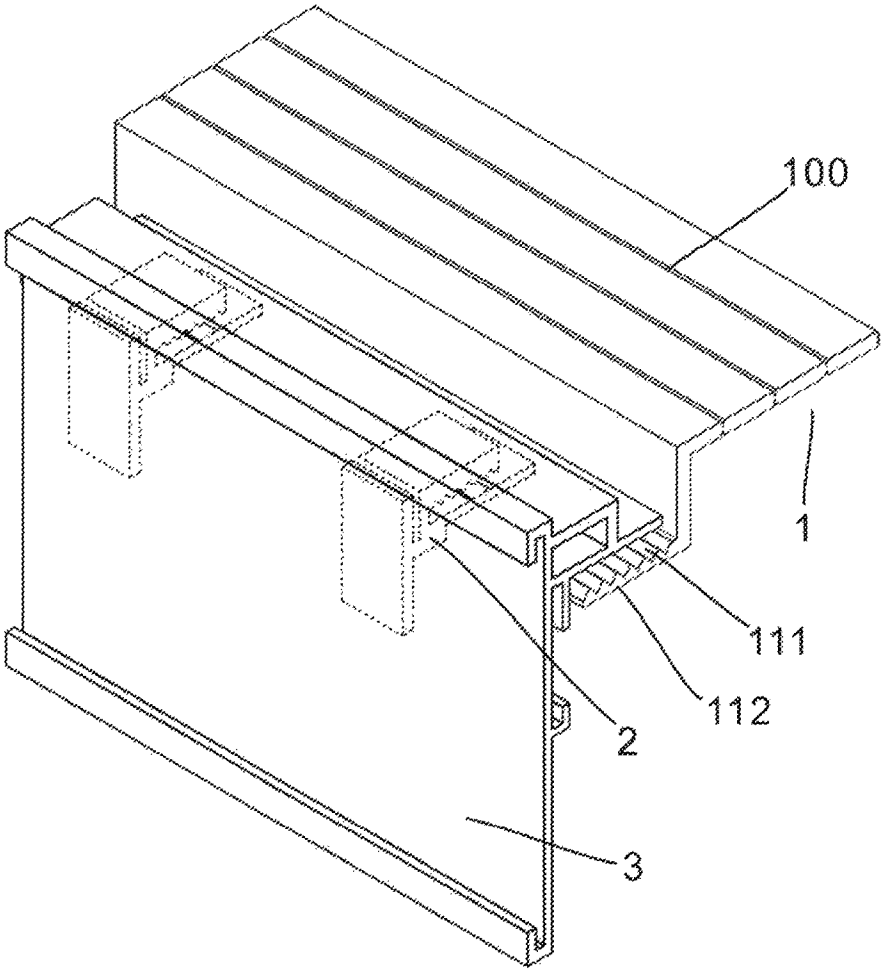
FIG. 12 is a perspective view showing still another embodiment of the installation of the connection board of the present invention.

Referring to FIG. 12, when the present invention is applied to a smaller window, the second connection section 12 is broken apart along the breakage slit 100 to shorten the length of the connection board 1. Then, the first connection section 11 is sequentially connected with the connection seats 2 and the decorative panel 3. Thereafter, the blind assembly 4 is installed under the connection board 1 to complete the installation of the blind. Similarly, the decorative panel 3 conceals the blind assembly 4 to achieve a beautiful appearance.

The above embodiments are only used to illustrate the present invention, not intended to limit the scope thereof. Many modifications of the above embodiments can be made without departing from the spirit of the present invention.

What is claimed is:

1. A universal omni adaptor comprising: a connection board as a main body, the connection board having a board main body, a first connection section and a second connection section, an upper face and a lower face of the board main body being formed with several breakage slits, the lower face of the board main body being for securely installing a blind assembly thereunder, the first connection section including a vertical board vertically extending from the board main body and a horizontal board horizontally extending from a rear end of the vertical board, the horizontal board being formed with toothed stripes, the second connection section including a horizontal board horizontally extending from the board main body and formed with toothed stripes, by means of the toothed stripes of the first connection section or the second connection section, the board main body being connected with a decorative panel via a connection seat to conceal the blind assembly.

2. The universal omni adaptor as claimed in claim 1, wherein the breakage slits are formed on the upper and lower faces of the board main body in alignment with each other.

* * * * *